US009838801B2

(12) United States Patent
Akino

(10) Patent No.: US 9,838,801 B2
(45) Date of Patent: Dec. 5, 2017

(54) UNIDIRECTIONAL CONDENSER MICROPHONE

(71) Applicant: Hiroshi Akino, Kanagawa (JP)

(72) Inventor: Hiroshi Akino, Kanagawa (JP)

(73) Assignee: KABUSHIKI KAISHA AUDIO TECHNICA, Tokyo (JP)

( * ) Notice: Subject to any disclaimer, the term of this patent is extended or adjusted under 35 U.S.C. 154(b) by 0 days.

(21) Appl. No.: 15/181,502

(22) Filed: Jun. 14, 2016

(65) Prior Publication Data

US 2016/0373865 A1 Dec. 22, 2016

(30) Foreign Application Priority Data

Jun. 16, 2015 (JP) ..... 2015-121041

(51) Int. Cl.

*H04R 9/08* (2006.01)
*H04R 19/04* (2006.01)
*H04R 1/34* (2006.01)

(52) U.S. Cl.

CPC ..... *H04R 19/04* (2013.01); *H04R 1/342* (2013.01)

(58) Field of Classification Search

CPC ..... H04R 1/083; H04R 1/086; H04R 17/00; H04R 17/02; H04R 19/004; H04R 19/016; H04R 19/04; H04R 21/02

See application file for complete search history.

(56) References Cited

U.S. PATENT DOCUMENTS 3,963,881 A † 6/1976 Fraim
4,410,770 A * 10/1983 Hagey ..... H04R 1/222 181/151
4,456,796 A * 6/1984 Nakagawa ..... H04R 1/38 381/357

FOREIGN PATENT DOCUMENTS

JP 2013-46194 3/2016

* cited by examiner
† cited by third party

*Primary Examiner* — Brian Ensey
(74) *Attorney, Agent, or Firm* — Whitham, Curtis & Cook

(57) ABSTRACT

A unidirectional condenser microphone having a front opening portion and a rear opening portion for respectively passing sound waves to a front surface and a back surface of a diaphragm of a microphone unit, the unidirectional condenser microphone includes: an acoustic tube provided in the front opening portion; a first air chamber provided between the rear opening portion and the back surface of the diaphragm of the microphone unit, and having a predetermined acoustic capacity; and a second air chamber communicating into the first air chamber, and having an acoustic capacity larger than the predetermined acoustic capacity, wherein sensitivity to a direction of 0° with respect to a directional axis is improved by the first air chamber and the acoustic tube, and a proximity effect due to the sound wave from a direction of 180° with respect to the directional axis is prevented by the second air chamber.

3 Claims, 8 Drawing Sheets

UNIDIRECTIONAL CONDENSER MICROPHONE

TECHNICAL FIELD

The present invention relates to a unidirectional condenser microphone.

BACKGROUND ART

Sensitivity and a low-band limit of a unidirectional microphone are changed according to tension of a diaphragm. In the unidirectional microphone, the sensitivity of the microphone is increased as the tension of the diaphragm becomes higher. However, in this case, a low-band sound collection limit is shifted to a higher frequency, and thus a sound wave having a low frequency is not collected. In contrast, if the tension of the diaphragm becomes lower, the low-band sound collection limit is shifted to a lower frequency, and the sound wave having a lower frequency becomes able to be collected. However, in this case, the sensitivity of the microphone is decreased. Further, in a condenser microphone, the diaphragm is easily stuck to a fixed electrode due to electrostatic absorption force in a case where the tension of the diaphragm is low. The condenser microphone cannot collect sounds if the diaphragm is stuck to the fixed electrode.

As described above, in unidirectional condenser microphones, frequency response of the diaphragm and the sensitivity are in a trade-off relationship.

JP 2013-46194 A describes a unidirectional microphone that includes a cylindrical acoustic resistance tube in a front surface of a diaphragm to obtain favorable directional frequency response and high sensitivity.

The conventional unidirectional microphone described in JP 2013-46194 A collects a sound wave of a sound source of a low-band frequency, if the sound source exists in a position proximity to the microphone in a direction of 180° with respect to a sound collecting axis. As described above, if the sound source exists in the position proximity to the microphone, the microphone collects the low-band sound wave with emphasis. Such a phenomenon is typically referred to as proximity effect.

Directivity of the unidirectional microphone is controlled by a sound pressure difference between two points. Therefore, a typical unidirectional microphone includes two opening portions through which the sound waves are taken in, in the front and rear of the microphone. In the conventional unidirectional microphone, when the sound source exists near the rear opening portion, a sound in a low frequency deviating from the sound collecting axis is emphatically collected due to the proximity effect. Therefore, the emphasized unnecessary low sound overlaps with a sound to be collected and deteriorates sound quality.

SUMMARY OF INVENTION

An object of the present invention is to provide a unidirectional condenser microphone that can realize favorable directivity regardless of a frequency of a sound wave.

According to the present invention, there is provided a unidirectional condenser microphone having a front opening portion and a rear opening portion for respectively passing sound waves to a front surface and a back surface of a diaphragm of a microphone unit, the unidirectional condenser microphone including: an acoustic tube provided in the front opening portion; a first air chamber provided between the rear opening portion and the back surface of the diaphragm of the microphone unit, and having a predetermined acoustic capacity; and a second air chamber communicating into the first air chamber, and having an acoustic capacity larger than the predetermined acoustic capacity, wherein sensitivity to a direction of 0° with respect to a directional axis is improved by the first air chamber and the acoustic tube, and a proximity effect due to the sound wave from a direction of 180° with respect to the directional axis is prevented by the second air chamber.

DESCRIPTION OF THE PREFERRED EMBODIMENTS

Hereinafter, an embodiment of a unidirectional condenser microphone according to the present invention will be described with reference to the drawings.

<Schematic Configuration of Unidirectional Condenser Microphone>

Figure 1:
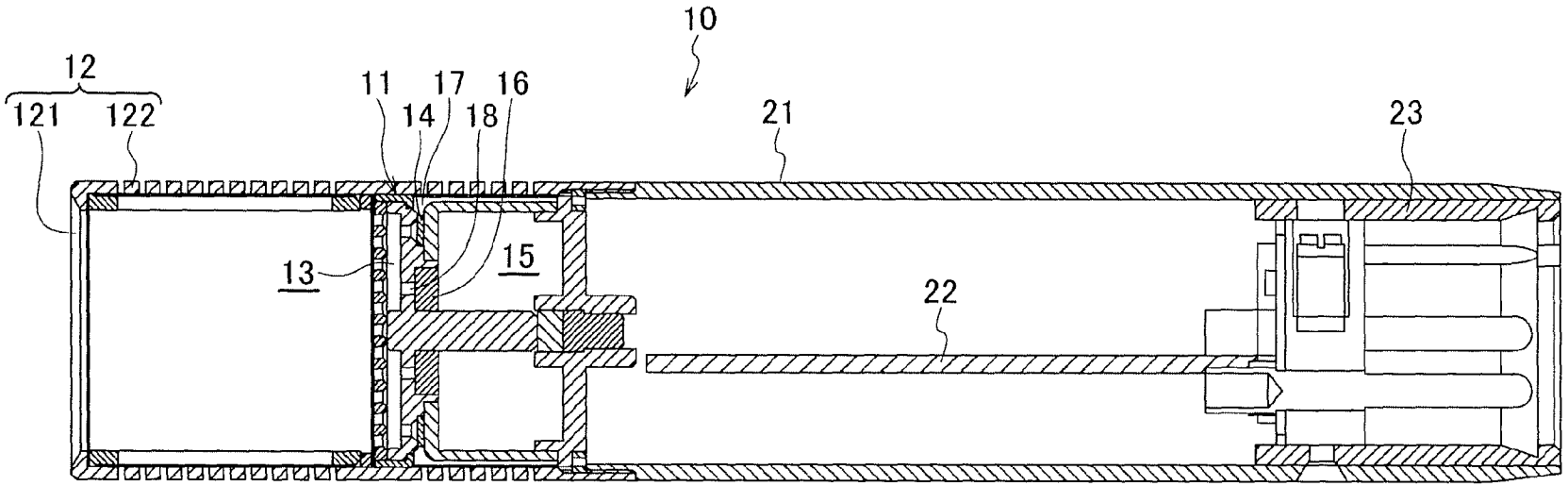
FIG. 1 is a sectional side view illustrating an embodiment of a unidirectional condenser microphone according to the present invention.

As illustrated in FIG. 1, a unidirectional condenser microphone 10 includes a microphone unit 11 and an acoustic tube 12 provided in front (at the left side on the sheet of FIG. 1) of the microphone unit 11. Further, the unidirectional condenser microphone 10 includes a first air chamber 13 provided in the rear (at the right side on the sheet of FIG. 1) of a diaphragm of the microphone unit 11 and a second air chamber 15 provided in the rear of the first air chamber 13 and in the rear of the microphone unit 11.

The unidirectional condenser microphone 10 includes a first acoustic resistance 14 that serves as an acoustic resistance of a sound wave that reaches the rear of the microphone unit 11, and a communicating path 18 that allow the first air chamber 13 and the second air chamber 15 to communicate into each other. Further, the unidirectional condenser microphone 10 includes a second acoustic resistance 16 provided between the first air chamber 13 and the second air chamber 15, and a rear opening portion 17 for passing the sound wave from an outside to the rear of the microphone unit 11.

The unidirectional condenser microphone 10 includes a cylindrical metal-made case 21, a circuit board 22 stored in the case 21, and an output connector 23 electrically connected with the circuit board 22, in the rear of the second air chamber 15. In the circuit board 22, a field effect transistor (FET) as an impedance converter, an amplifier circuit, a low-cut circuit, and the like are mounted.

<Specific Configuration of Unidirectional Condenser Microphone>

Figure 2:
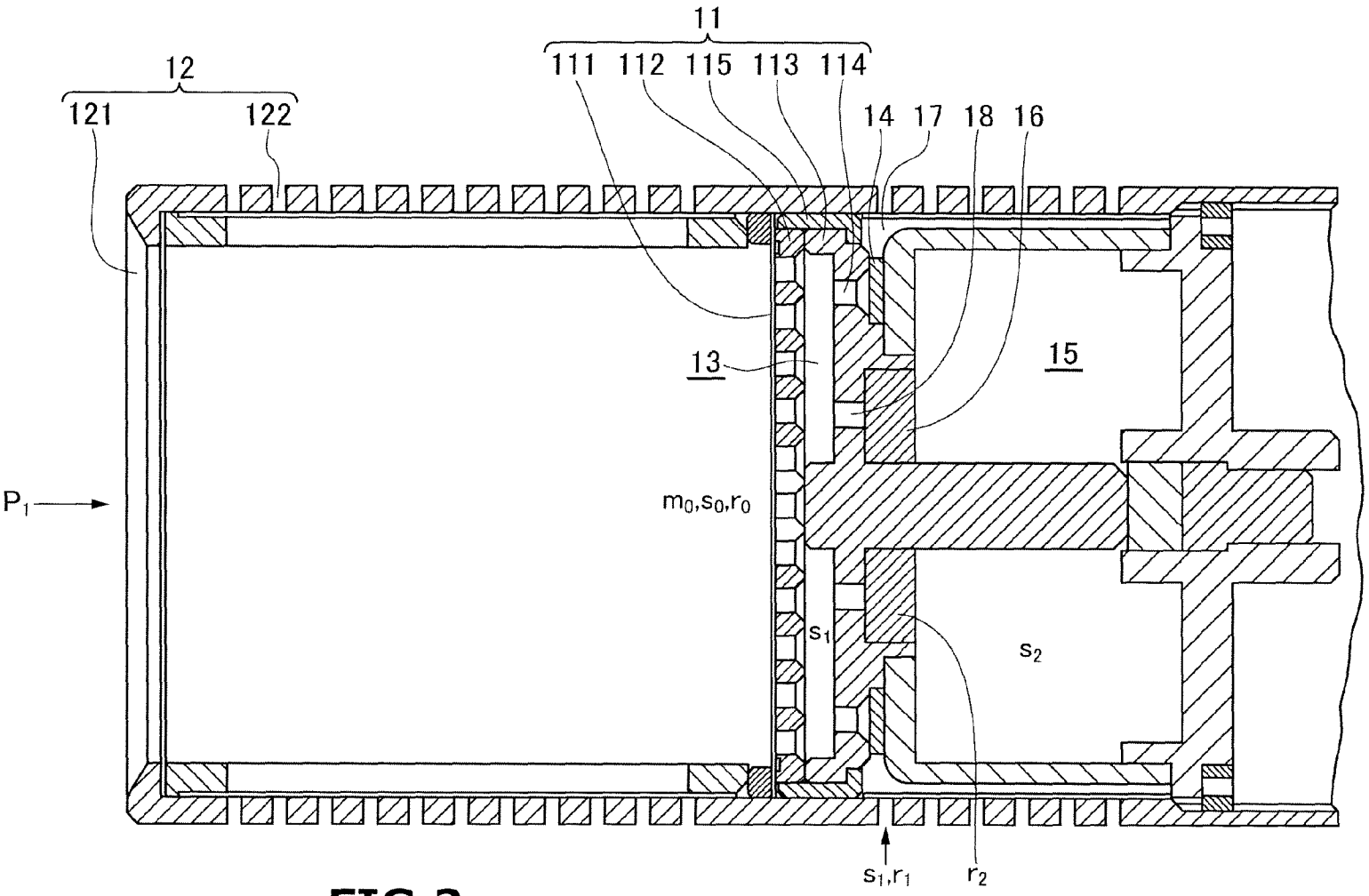
FIG. 2 is an enlarged sectional side view illustrating the unidirectional condenser microphone of FIG. 1.

A specific configuration example of the unidirectional condenser microphone 10 will be described using an enlarged sectional view of a side surface illustrated in FIG. 2. The microphone unit 11 includes a diaphragm 111 that vibrates by the sound wave from an outside and a fixed electrode 112 that configures a condenser together with the diaphragm 111. Further, the microphone unit 11 includes an insulating holder 113 that holds the diaphragm 111 and the fixed electrode 112, and a unit case 115 that holds the diaphragm 111, the fixed electrode 112, and the like. The insulating holder 113 has a through path 114 that passes the sound wave taken in through the rear opening portion 17 to the first air chamber 13.

The acoustic tube 12 is at a front surface side of the diaphragm 111, and is a hollow tubular member provided in a front opening portion of the microphone unit 11. The acoustic tube 12 includes a front surface opening portion 121 provided in a position facing the front surface of the diaphragm 111, and a tube wall opening portion 122 provided in a tube wall of a side surface of the acoustic tube 12. The front opening portion is configured from the front surface opening portion 121 and the tube wall opening portion 122. The acoustic tube 12 passes the sound wave from a front of the unidirectional microphone 10 to the front surface of the diaphragm 111 through the front opening portion, that is, the front surface opening portion 121 and the tube wall opening portion 122.

The first air chamber 13 is formed of the fixed electrode 112 and the unit case 115 at aback surface side of the diaphragm 111, as described above. The first air chamber 13 is a space having a predetermined acoustic capacity. The first air chamber 13 communicates into the back surface of the diaphragm 111 through an opening portion provided in the fixed electrode 112.

The first acoustic resistance 14 is provided on a path of the sound wave that passes through the through path 114 and is introduced into the first air chamber 13, and serves as an acoustic resistance of the sound wave introduced through the rear opening portion 17 into the first air chamber 13.

The second air chamber 15 communicates into the first air chamber 13 through the communicating path 18. The second air chamber 15 communicates into the first air chamber 13, thereby the second air chamber 15 communicates into the back surface of the diaphragm 111 of the microphone unit 11. The second air chamber 15 is a space having a larger acoustic capacity than the predetermined acoustic capacity of the first air chamber 13.

The second acoustic resistance 16 is provided between the first air chamber 13 and the second air chamber 15, to be specific, at a front side of the communicating path 18 as viewed from the second air chamber 15. The second acoustic resistance 16 serves as an acoustic resistance of the sound wave that passes between the first air chamber 13 and the second air chamber 15. The second acoustic resistance 16 allows the sound wave having a frequency in a lower frequency range than a predetermined frequency to pass between the first air chamber 13 and the second air chamber 15.

As described above, the unidirectional condenser microphone 10 includes the two air chambers including the first air chamber 13 and the second air chamber 15 in the rear of the diaphragm 111. Respective functions of the first air chamber 13 and the second air chamber 15 will be described below. The sound waves taken in through the rear opening portion 17 where a rear acoustic terminal is positioned are divided into two paths like below according to its frequency, and reach the back surface of the diaphragm 111.

The sound wave having a higher frequency in a middle and high range than the predetermined frequency is divided at the first acoustic resistance 14 and the first air chamber 13, and applies a pressure to the back surface of the diaphragm 111, so that this configuration realizes unidirectivity. That is, the sound wave having the frequency in the middle and high range reaches the back surface of the diaphragm 111 only through the first air chamber 13.

Meanwhile, the sound wave having a lower-band frequency than the predetermined frequency is divided at the first acoustic resistance 14 and the second acoustic resistance 16, and reaches the back surface of the diaphragm 111. That is, in the sound wave having the low-band frequency, an effect of the second air chamber 15 larger than the first air chamber 13 is dominant. As a result, a non-directional component, of components that configure the unidirectivity, is enhanced by the second air chamber 15, and an increase in a low-pitched range due to the proximity effect can be prevented even if there is a sound source near the rear opening portion.

<Acoustic Equivalent Circuit>

Figure 3:
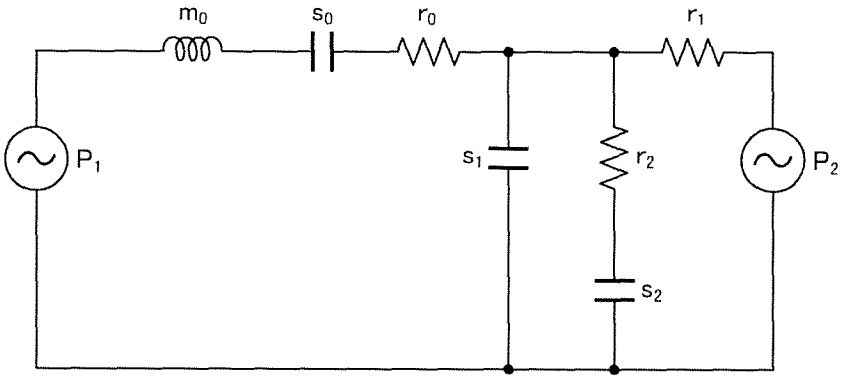
FIG. 3 is a circuit diagram illustrating an acoustic equivalent circuit of the unidirectional condenser microphone of FIG. 1.

FIG. 3 illustrates an acoustic equivalent circuit of the unidirectional condenser microphone 10. In FIG. 3, the sound wave taken in from the front of the acoustic tube 12 is $P_1$, an acoustic mass of the diaphragm 111 is $m_0$, stiffness of the diaphragm 111 is $s_0$, a damping resistance of the diaphragm 111 is $r_0$. Further, the sound wave taken in through the rear opening portion 17, of the sound waves transmitted from the front of the acoustic tube 12, is $P_2$. Further, the acoustic resistance of the first acoustic resistance 14 is $r_1$, and the acoustic resistance of the second acoustic resistance 16 is $r_2$. Further, the acoustic capacity of the first air chamber 13 is $s_1$, and the acoustic capacity of the second air chamber 15 is $s_2$. For easy understanding, these reference numerals are appropriately added to FIG. 2.

The unidirectional condenser microphone 10 obtains the non-directional component as the sound wave $P_1$ reaches the front surface of the diaphragm 111 and obtains a bi-directional component as the sound wave $P_2$ reaches the back surface of the diaphragm 111, thereby to realize the unidirectivity. To be specific, the unidirectional condenser microphone 10 connects the acoustic capacity $s_1$ of the first air chamber 13 and the second air chamber 15 with the acoustic resistance $r_2$. Therefore, the sound wave having a low-band frequency is divided at the acoustic resistance $r_1$ and the acoustic resistance $r_2$, and reaches the back surface of the diaphragm 111. Therefore, the configuration with an acoustic capacity $s_2$ becomes equivalent to a configuration operated with a large air chamber, and drive force of the non-directional component is increased.

As described above, the acoustic capacity $s_2$ of the second air chamber 15 is larger than the acoustic capacity $s_1$ of the first air chamber 13, and thus the acoustic capacity $s_2$ of the second air chamber 15 dominantly functions in the low-band frequency. Further, the unidirectional condenser microphone 10 is operated with the acoustic capacity $S_1$ of only the first air chamber 13 in the sound wave having a frequency in a middle and high range, and thus similarly functions to typical unidirectional microphones.

Figure 4:
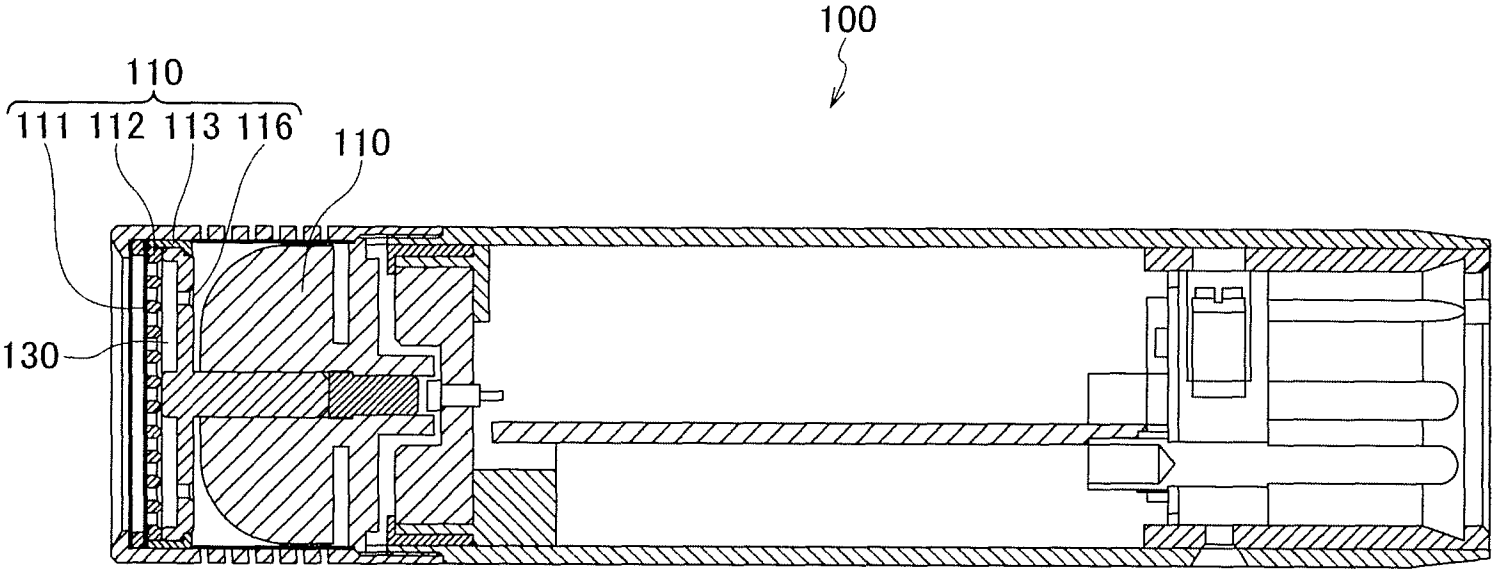
FIG.4 RELATED ART
FIG. 4 is a sectional side view of a unidirectional condenser microphone of a reference example.

FIG. 4 illustrates a unidirectional condenser microphone 100 as a reference example. The unidirectional condenser microphone 100 includes a diaphragm 111, a fixed electrode 112, an insulating holder 113, and a through path 116, and has a similar configuration to the microphone unit 11 of the unidirectional condenser microphone 10. Meanwhile, the unidirectional condenser microphone 100 is not provided with a second air chamber 15 and is provided with an insulating cap 110 in the rear of an air chamber 130 formed of the fixed electrode 112 and the insulating holder 113.

Figure 5:
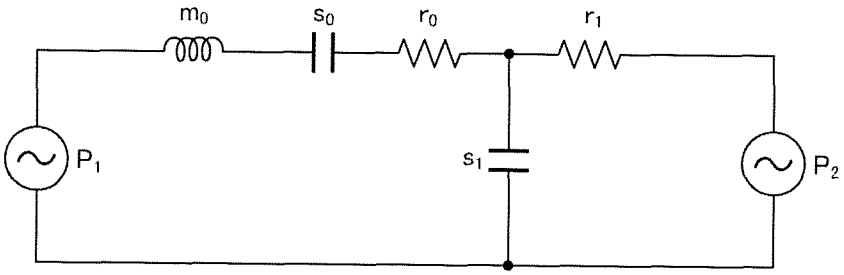
FIG.5 RELATED ART
FIG. 5 is a circuit diagram illustrating an acoustic equivalent circuit of the unidirectional condenser microphone of the reference example.

As illustrated in an acoustic equivalent circuit of FIG. 5, the unidirectional microphone 100 does not include an acoustic capacity $s_2$ of a second air chamber 15 and an acoustic resistance $r_2$ of a second acoustic resistance 16, and thus a non-directional component by a sound wave having a low-band frequency is not increased. That is, the unidirectional microphone 100 of the reference example is easily subject to proximity effect.

<Directivity Pattern and Directional Frequency Characteristics>

Figure 6A:
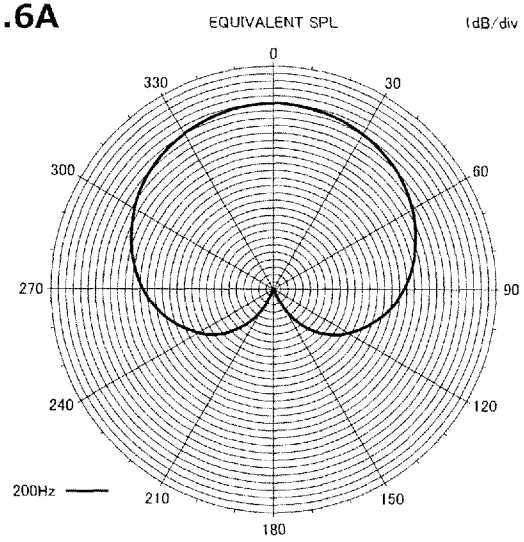
FIG. 6A is a characteristic diagram illustrating a directivity pattern of the unidirectional condenser microphone of FIG. 1.
Figure 6B:
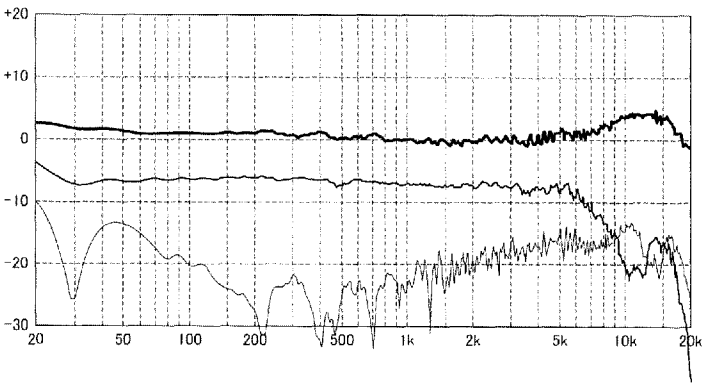
FIG. 6B is a graph illustrating directional frequency characteristics of the unidirectional condenser microphone of FIG. 1.

A characteristic diagram of a directivity pattern of the unidirectional microphone 10 according to the present embodiment is illustrated in FIG. 6A, and a graph of directional frequency characteristics of the unidirectional microphone 10 is illustrated in FIG. 6B, respectively. As illustrated in FIG. 6A, the unidirectional microphone 10 obtains excellent unidirectivity. Further, as illustrated in FIG. 6B, in the unidirectional microphone 10, sound collection of the low-band frequency is suppressed in a direction of 180° with respect to a sound collecting axis. Further, frequency response in a direction of 90° with respect to the sound collecting axis becomes flat. Thus, frequency directional characteristics of the unidirectional microphone 10 is stable from the low band to the high band.

Figure 7A:
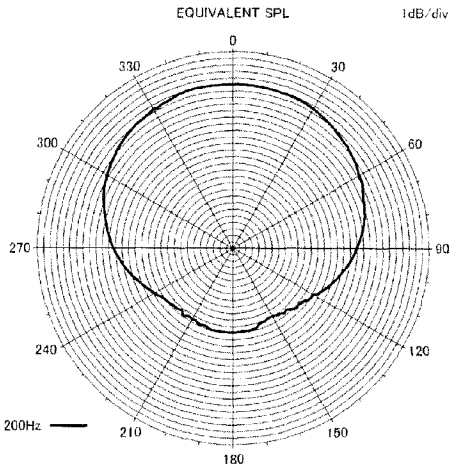
FIG.7A RELATED ART
FIG. 7A is a characteristic diagram illustrating a directivity pattern of the unidirectional condenser microphone as a reference example.
Figure 7B:
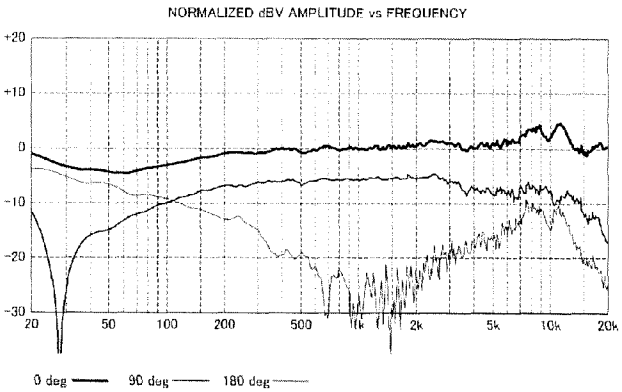
FIG.7B RELATED ART
FIG. 7B is a graph illustrating directional frequency characteristics of the unidirectional condenser microphone of the reference example.

A characteristic diagram of a directivity pattern of the unidirectional microphone 100 of the reference example is illustrated in FIG. 7A, and a graph of directional frequency characteristics of the unidirectional microphone 100 is illustrated in FIG. 7B, respectively. As illustrated in FIG. 7A, it can be seen that the unidirectional microphone 100 collects sounds even in a direction of 180° with respect to a sound collecting axis, compared with the unidirectional microphone 10 according to the present embodiment illustrated in FIG. 6A. Further, as illustrated in FIG. 7B, it can be seen that the unidirectional microphone 100 collects sounds having a low-band frequency in the direction of 180° with respect to the sound collecting axis.

That is, compared with the unidirectional microphone 100 of the reference example, the proximity effect is decreased and the favorable directivity is obtained regardless of the frequency in the unidirectional microphone 10 according to the present embodiment.

Figure 8A:
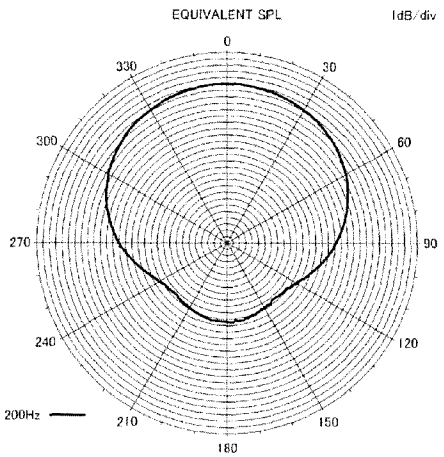
FIG.8A RELATED ART
FIG. 8A is a characteristic diagram illustrating a directivity pattern of a unidirectional condenser microphone as another reference example.
Figure 8B:
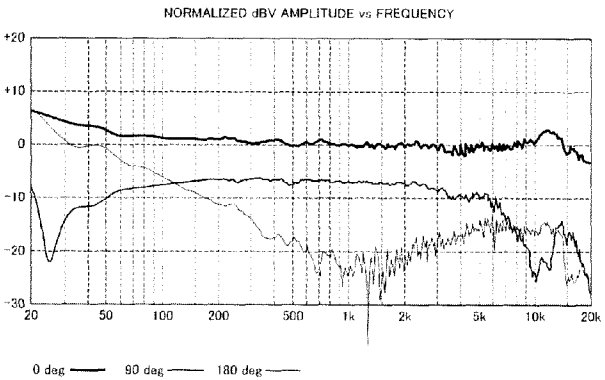
FIG.8B RELATED ART
FIG. 8B is a graph illustrating directional frequency characteristics of a unidirectional condenser microphone of another reference example.

A characteristic diagram of a directivity pattern of a unidirectional microphone of another reference example is illustrated in FIG. 8A, and a graph of directional frequency characteristics of the reference example is illustrated in FIG. 8B, respectively. A unidirectional microphone of another reference example is obtained by attaching an acoustic tube to the front surface of the diaphragm 111 of the unidirectional microphone 100 of the above-described reference example.

As illustrated in FIGS. 8A and 8B, it can be seen that the unidirectional microphone of another reference example also collects sounds having a low-band frequency in a direction of 180° with respect to a sound collecting axis.

That is, as can be seen from comparison with the unidirectional microphones of the reference examples, the proximity effect is decreased and the favorable directivity is obtained regardless of the frequency in the unidirectional microphone 10 according to the present embodiment.

As described above, according to the unidirectional microphone 10 according to the present embodiment, the first air chamber 13 and the second air chamber 15 having a larger acoustic capacity than the first air chamber are included, whereby the favorable directivity can be realized regardless of the frequency of the sound wave.

Especially, according to the unidirectional microphone 10, the proximity effect of the sound wave having the low-band frequency in the direction of 180° with respect to the sound collecting axis is decreased, and the excellent directional characteristics can be obtained.

What is claimed is:

1. A unidirectional condenser microphone having a front opening portion and a rear opening portion for respectively passing sound waves to a front surface and a back surface of a diaphragm of a microphone unit, the unidirectional condenser microphone comprising:

an acoustic tube provided in the front opening portion;

a first air chamber provided between the rear opening portion and the back surface of the diaphragm of the microphone unit, and having a predetermined acoustic capacity; and a second air chamber communicating into the first air chamber, and having an acoustic capacity larger than the predetermined acoustic capacity of the first air chamber, wherein sensitivity to a direction of 0° with respect to a directional axis is improved by the first air chamber and the acoustic tube, and a proximity effect due to the sound wave from a direction of 180° with respect to the directional axis is prevented by the second air chamber.

2. The unidirectional condenser microphone according to claim 1, further comprising:

a first acoustic resistance provided between the rear opening portion and the first air chamber; and a second acoustic resistance provided between the first air chamber and the second air chamber, wherein a sound wave having a frequency lower than a predetermined frequency and taken in through the rear opening portion is divided by the first acoustic resistance and the second acoustic resistance and reaches the back surface of the diaphragm, and a sound wave having a frequency higher than the predetermined frequency and taken in through the rear opening portion is divided by the first acoustic resistance and the first air chamber and reaches the back surface of the diaphragm.

3. The unidirectional condenser microphone according to claim 2, wherein the second air chamber enhances a non-directional component for the sound wave having a frequency lower than the predetermined frequency.

* * * * *